US006053157A

United States Patent [19]

Frank

[11] Patent Number: 6,053,157

[45] Date of Patent: Apr. 25, 2000

[54] FLUID PROPULSION DEVICE FOR USE IN A PROJECTILE LAUNCHING SYSTEM

[75] Inventor: Thomas A. Frank, Middletown, R.I.

[73] Assignee: The United States of America as represented by the Secretary of the Navy, Washington, D.C.

[21] Appl. No.: 09/049,658

[22] Filed: Mar. 23, 1998

[51] Int. Cl.[7] ..... F41B 11/00

[52] U.S. Cl. ..... 124/70; 124/71; 124/73; 114/238

[58] Field of Search ..... 124/70, 71, 73, 124/75–77; 114/238; 91/392; 89/1.81

[56] References Cited

U.S. PATENT DOCUMENTS

| | | | |
|---|---|---|---|
| 4,848,210 | 7/1989 | Bissonnette | 89/1.81 |
| 5,200,572 | 4/1993 | Bissonnette | 89/1.81 |
| 5,373,832 | 12/1994 | D'Andrade | 124/69 |
| 5,373,833 | 12/1994 | D'Andrade | 124/69 |
| 5,645,006 | 7/1997 | Moody | 114/238 |
| 5,779,728 | 7/1998 | Lunsford et al. | 606/190 |

*Primary Examiner*—J. Woodrow Eldred
*Attorney, Agent, or Firm*—Michael J. McGowan; Prithvi C. Lall; James M. Kasischke

[57] ABSTRACT

A fluid propulsion device is used to discharge a working fluid at a predetermined variable discharge rate. The fluid propulsion device includes a fluid chamber that is expandable upon receiving the working fluid. The fluid chamber has a plurality of chamber sections that contract at different predetermined rates to discharge the working fluid from the fluid chamber at the variable discharge rate. In one example, an elastomeric bladder defines the fluid chamber and includes a plurality of bladder sections each having a different coefficient of elasticity, causing the bladder sections to contract at the different predetermined rates. In one application, the fluid propulsion device is used in a projectile launching system, such as an airgun. The fluid propulsion system controls the launching of the projectile by discharging the working fluid at the variable discharge rate, resulting in a corresponding acceleration of the projectile.

20 Claims, 4 Drawing Sheets

FLUID PROPULSION DEVICE FOR USE IN A PROJECTILE LAUNCHING SYSTEM

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to fluid propulsion devices and in particular, to a fluid propulsion device that discharges working fluid at variable rates to accelerate a projectile.

(2) Description of the Prior Art

One way of launching projectiles is with a working fluid capable of storing potential energy that is converted to kinetic energy, causing the working fluid to accelerate the projectile. Some existing projectile launching systems include ram pump and turbine pump projection systems. Both such systems are mechanically complex and tend to radiate noise into the surrounding fluid medium during launching of the projectile.

Other systems have used elastomeric bladders for storing the potential energy of a working fluid. The working fluid expands the bladder, and upon contraction of the bladder, the fluid is released or discharged and causes acceleration of the projectile. The existing elastomeric bladders used to store potential energy of a working fluid have also met with a number of limitations.

Many existing elastomeric bladders utilize a non-compressible fluid, such as water, as disclosed in U.S. Pat. No. 5,200,572. This type of system only stores the potential energy in the elastomeric walls of the bladder. No energy is stored in the non-compressible working fluid, itself.

Existing projectile launching systems also have a limited ability to vary or define the desired discharge rate of the working fluid expelled or released from the elastomeric bladder. The inability to control the discharge rate of the working fluid expelled from the elastomeric bladder results in the inefficient conversion of potential energy to kinetic energy in launching a projectile. Moreover, the uncontrolled discharge of the working fluid in existing projectile launching systems causes an uncontrolled acceleration of the projectile, resulting in excessive noise, vibration, and inaccuracy of the launched projectile.

Existing pneumatic guns (or airguns), for example, propel their projectiles with a gas, supplied from either a gas cylinder or via a piston spring arrangement. Overdischarge of the gas causes a "blowby" of the discharging gas as the projectile is fired, thereby adversely affecting the projectile's trajectory path. This type of pneumatic gun also experiences a significant recoil when fired and significant noise or "blast" caused by the discharging gas leaving the barrel or bore of the projectile launcher. Underdischarge of the gas often causes deceleration of the projectile before exiting the barrel or bore of the gun.

SUMMARY OF THE INVENTION

Accordingly, one object of the present invention is a fluid propulsion device that uses a working fluid, such as compressed gas, to store potential energy and to provide a variable rate of discharge of the working fluid that can be modified for a particular application.

A further object is a projectile launching system that uses a fluid propulsion device that efficiently uses the kinetic energy of the discharging working fluid to provide a variable acceleration to a projectile and to launch the projectile with increased accuracy and velocity and reduced noise and vibration.

The present invention features a fluid propulsion device for discharging working fluid, preferably a compressed gas, at a predetermined variable discharge rate. The fluid propulsion device comprises a fluid chamber that is expandable upon receiving the working fluid and contractible upon discharging the working fluid. The fluid chamber includes a plurality of chamber sections, each of which has a predetermined coefficient of elasticity for contracting at a different predetermined rate and discharging the working fluid from the fluid chamber at the variable discharge rate. One or more apertures, such as an inlet and outlet, communicate with the fluid chamber for allowing the working fluid to be received and discharged.

According to one embodiment, the fluid chamber includes an elastomeric bladder having a plurality of elastomeric bladder sections. Each of the elastomeric bladder sections has a different predetermined coefficient of elasticity for contracting the elastomeric bladder sections at the different predetermined rates. In one example, the plurality of elastomeric bladder sections are formed as a plurality of elastomeric rings bonded together.

According to another embodiment, the fluid chamber includes a bladder, a mounting portion to which the bladder is mounted, and a plurality of elastomeric members extending from the mounting portion to a plurality of bladder sections within the bladder. Each of the plurality of elastomeric members has a different predetermined coefficient of elasticity for contracting the plurality of bladder sections at the different predetermined rates.

According to a further embodiment, the fluid chamber includes a hollow member having a first and a second end. A sealed sliding member is slidably disposed in the hollow member proximate the second end of the hollow member. The sealed sliding member slides within the hollow member to expand the fluid chamber upon receiving working fluid and to contract the fluid chamber upon discharging the working fluid through the one or more apertures at the first end. At least one sliding ring is slidably disposed within the hollow member between the first end and the sealed sliding member proximate the second end, for forming the plurality of chamber sections. At least a first resilient member couples the sliding ring to the hollow chamber proximate the first end of the hollow chamber. At least a second resilient member couples the sliding ring to the sealed sliding member. The first and second resilient members cause the plurality of chamber sections formed within the hollow member to contract at the different predetermined rates upon discharging the working fluid.

One example of the first and second resilient members includes first and second springs, each having a different spring constant. According to the preferred embodiment, first and second sliding rings are slidably disposed within the hollow member. The first sliding ring is coupled proximate the first end of the hollow member with the first resilient member. The second sliding ring is coupled to the sealed sliding member with the second resilient member. A third resilient member couples the first and second sliding rings together.

The present invention also features a projectile launching system for launching a projectile using the working fluid discharged at a variable discharge rate. The projectile launching system includes a launching region and one or more projectiles disposed in the launching region for being launched through the launching region. A fluid chamber including a plurality of chamber sections that contract at different predetermined rate, as defined above, is coupled with the launching region for providing the working fluid at the variable discharge rate and accelerating the projectile through the launching region.

The fluid chamber is preferably calibrated so that the different predetermined rates of contraction provide a discharge rate of zero when the projectile is at the exit of the launching region.

BRIEF DESCRIPTION OF THE DRAWINGS

These and other features and advantages of the present invention will be better understood in view of the following description of the invention taken together with the drawings wherein.

DETAILED DESCRIPTION OF THE PREFERRED EMBODIMENT

Figure 1:
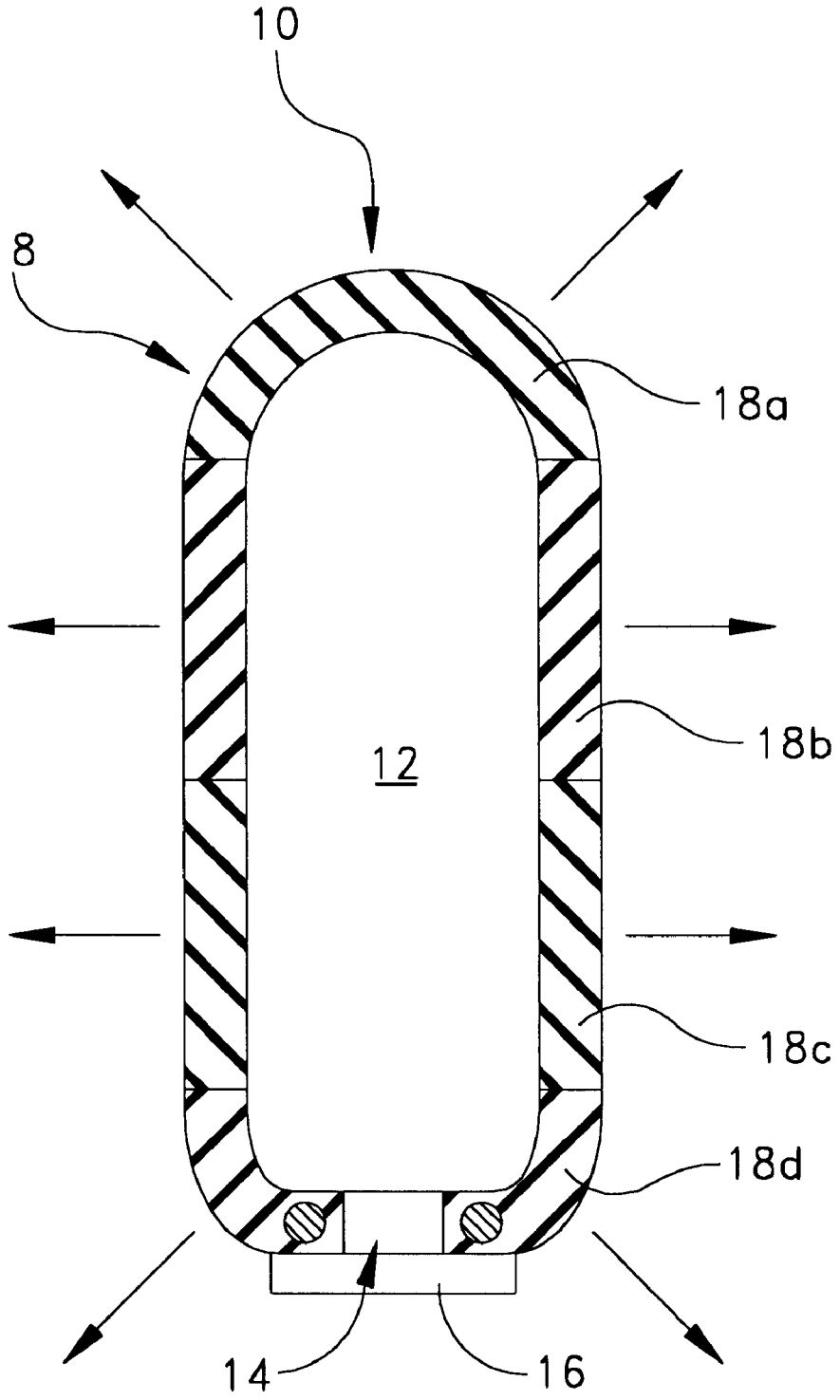
FIG. 1 is a cross-sectional view of a fluid propulsion device according to one embodiment of the present invention.

A fluid propulsion device 10, FIG. 1, according to the present invention, is used to discharge a working fluid, such as a compressed gas, at a variable discharge rate. One application for the fluid propulsion device 10 is to propel or launch a projectile in a projectile launching system, as will be described in greater detail below.

The fluid propulsion device 10 stores potential energy of the working fluid and converts that potential energy to kinetic energy by discharging the working fluid. A compressed gas is preferably used as the working fluid so that potential energy is also stored in the compressed gas, allowing a more efficient and precise conversion of potential energy to kinetic energy as the compressed gas is discharged.

The fluid propulsion device 10 includes a fluid chamber 12 that is expandable upon receiving the working fluid through one or more apertures 14 formed in a base portion 16 and contractible upon discharging the working fluid at the variable discharge rate. The fluid propulsion device 10 allows the discharge rate of the working fluid to be varied by varying the rate at which sections of the chamber 12 contract when the working fluid is discharged.

In one embodiment, the fluid propulsion device 10 includes an elastomeric bladder 18, having a plurality of elastomeric bladder sections 18*a*–18*d*, that define a plurality of chamber sections. Each of the elastomeric bladder sections 18*a*–18*d* has a predetermined elasticity, for contracting the plurality of chamber sections at predetermined rates. When the working fluid is received into the elastomeric bladder 18, each of the bladder sections 18*a*–18*d* are stretched in differing amounts depending upon their degree of elasticity. When the pressure is released, the elastomeric bladder sections 18*a*–18*d* contract at different rates based on their elastic potential as the working fluid is discharged through the aperture 14.

The potential energy stored in each of the elastomeric bladder sections 18*a*–18*d* and the working fluid (e.g., compressed gas) is then converted to kinetic energy in the form of the working fluid flowing from the bladder 18. The discharge rate or flow rate of the working fluid discharged from the bladder 18 is therefore controlled by the elasticity of each bladder section 18*a*–18*d*. Examples of suitable materials used for the elastomeric bladder include, but are not limited to, neoprene rubber, urethane, latex, nylon, polyethylene, butyl rubber, gum rubber, vinyl, PVC, PTFE and other elastomeric materials. One example of the different degrees of elasticity as measureed by Young's Modulus in each of the elastomeric bladder sections 18*a*–18*d* is $5\times10^6$ Pa (soft rubber)–$2.3\times10^9$ Pa (hard rubber).

In one example, the elastomeric bladder sections 18*a*–18*d* are formed as rings of elastomeric material having different elastic potentials. The rings are bonded together in a "stack" using adhesives known in the art. The present invention also contemplates an elastomeric bladder 18 of a single piece of elastomeric material that varies in elasticity continuously throughout the single piece of elastomeric material.

In the exemplary embodiment, the bladder 18 is mounted to a base portion 16. One or more apertures 14 are preferably formed in the base portion 16, for example, as an inlet/outlet for the working fluid.

Figure 2:
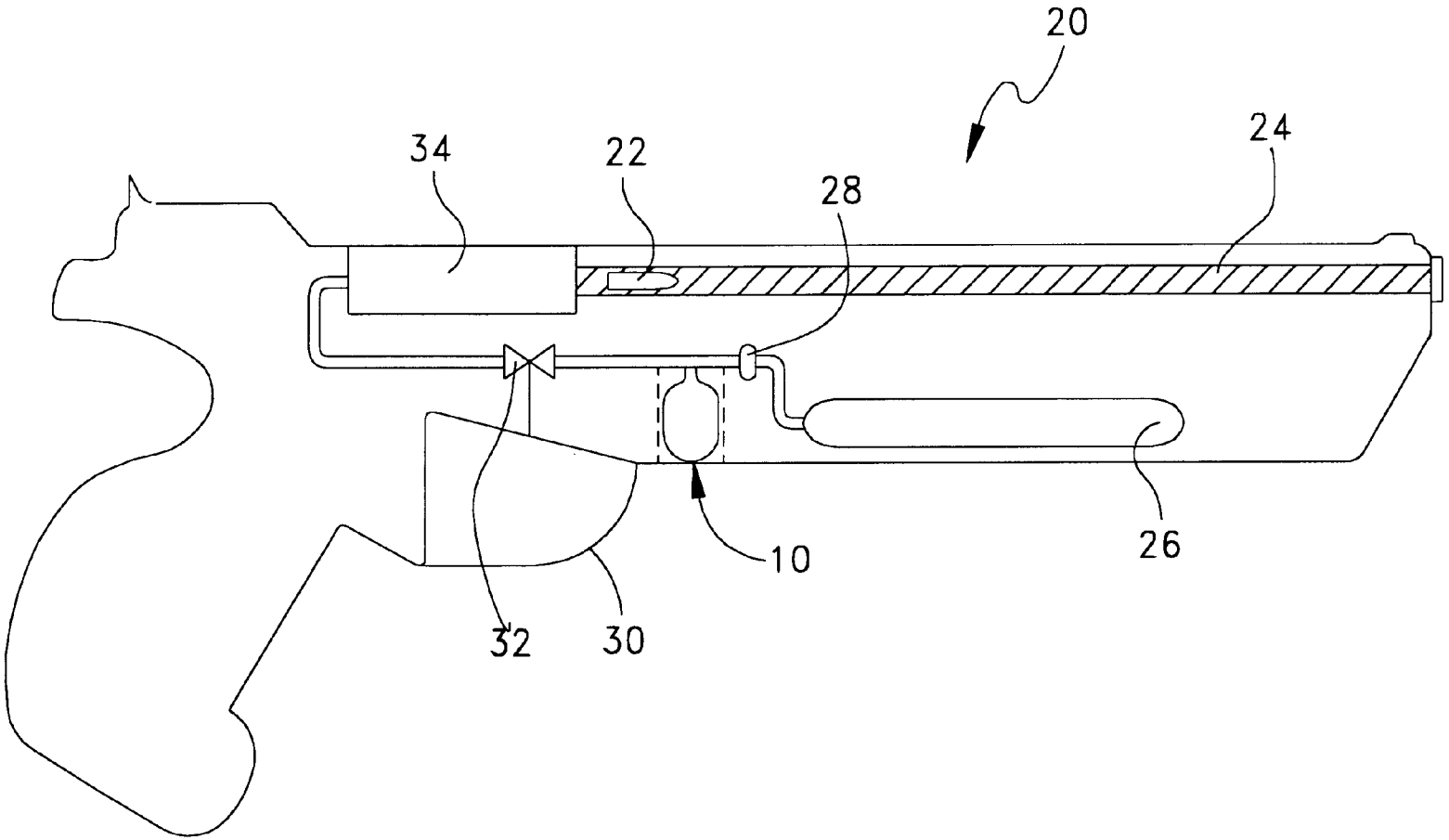
FIG. 2 is a side schematic view of a projectile launching device according to one embodiment of the present invention utilizing the fluid propulsion device of FIG. 1.

The present fluid propulsion device 10, FIG. 2, can be used with a projectile launching system 20, such as an air gun, to propel a projectile 22 from a firing chamber 34 through a launching region 24. The projectile launching system 20 preferably includes a working fluid reservoir 26, such as a gas cylinder, coupled to the fluid propulsion device 10 by way of a charging valve 28.

Activating the charging valve 28, i.e., "cocking" the projectile launching system 20, causes the working fluid or compressed gas from the reservoir 26 to charge or be received in the fluid propulsion device 10. Prior to firing the projectile 22, the charge valve 28 is closed. The pressure of the working fluid in the reservoir 26 (or gas cylinder) can be regulated to provide the working fluid or compressed gas at a preset pressure to the fluid propulsion device 10.

The projectile launcher 20 further includes a trigger 30 that activates a discharge valve 32 joined between fluid propulsion device 10 and firing chamber 34. Activation of trigger 30 allows the working fluid in the fluid propulsion device 10 to be discharged and the projectile 22 to be fired. The kinetic energy or pressure release of the fluid or compressed gas discharged causes the projectile 22 to accelerate through the launching region 24, such as the barrel or bore of a gun.

According to an alternative embodiment, a pump, such as a hand pump, is used in place of the reservoir 26 or together with the reservoir 26 to charge the fluid propulsion device 10 with the working fluid. The pump is used to pump the reservoir 26 (e.g., gas cylinder) to the desired pressure and the working fluid in the reservoir 26 is then released into the fluid propulsion device 10.

According to a further embodiment, the trigger 30 actuates both the charge valve 28 and discharge valve 32. Moving the trigger 30 to a first trigger position causes the working fluid or compressed gas to be transferred from the reservoir 26 to the fluid propulsion device 10. Moving the trigger 30 to a second trigger position seals the reservoir 26, i.e., closes the charge valve 28. Moving the trigger 30 to a third trigger position releases or discharges the working fluid or compressed gas from the fluid propulsion device 10 to the firing chamber 34, causing the projectile 22 to be accelerated through the launching region 24.

Another application for the fluid propulsion device of the present invention is for launching an object, such as a satellite in space. Since the launching of an object in space affects the trajectory of the launch vehicle, using a fluid propulsion device 10 with a known acceleration profile allows the effect on the trajectory of the launch vehicle to be precisely determined. The present invention contemplates various types of projectile launching systems 20 including, but not limited to, submarine projectile launching systems, and match target air guns. This device may also be used for any other application requiring a highly controlled fluid impulse.

A fluid propulsion device 10 providing a variable discharge rate, as described above, is used in the projectile launching system 20 to provide a desired acceleration of the projectile 22. The fluid propulsion device 10 is preferably interchangeable within the projectile launching system 20 so that different fluid propulsion devices 10 can be interchanged to provide different acceleration profiles.

According to one example, the fluid propulsion device 10, the projectile 22, and the launching region 24 are calibrated to optimize acceleration of the projectile, reduce noise and vibration in launching the projectile, or increase the accuracy of the launched projectile. The sections of the fluid chamber 12 (see FIG. 1) are designed, e.g., by varying the elasticity in the bladder sections 18*a*–18*d*, to cause the working fluid to discharge at a discharge rate that provides desired acceleration profile for a particular projectile launching system 20.

Figure 3:
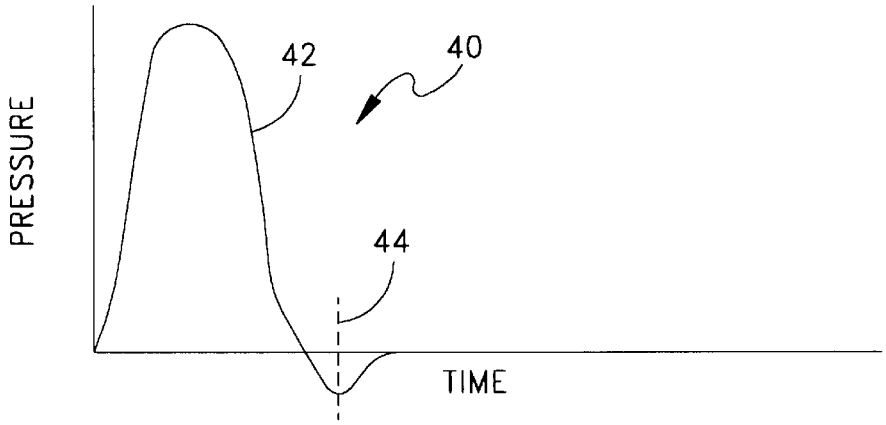
FIG. 3 is a discharge pressure curve of a fluid propulsion device according to one embodiment of the present invention.

The variable discharge rate can be represented by a discharge pressure curve 40, FIG. 3, that indicates the pressure of the working fluid being discharged over time and corresponds to the acceleration of a projectile 22 over time as the projectile 22 is launched from a launching region 24. The fluid propulsion device 10 is designed to provide a discharge pressure curve 40 that is desirable for a particular projectile launching system. One such discharge pressure curve 40 provides for a significant pressure change in the working fluid being discharged at firing, as indicated by the steeply declining portion 42 of the pressure curve 40, to provide a rapid acceleration to the projectile 22.

One of the limitations on the absolute accuracy of Olympic quality airguns is the fact that as the projectile 22 (lead pellet) exits the barrel or launching region 24, the gas which is pushing it blows out around the skirt of the projectile 22. Since neither the skirt of the projectile nor the crown of the muzzle (end of the barrel) can be made perfectly symmetrical, the gas which blows by the projectile at exit can create a force or moment on the tail of the projectile 22 which causes it to deviate slightly from its intended trajectory. By defining the pressure/acceleration curve such that at the point in time when the projectile leaves the muzzle or end of the launching region 24, the propelling gas pressure goes to zero, there will be no "blowby", and hence no upset in the trajectory.

According to the preferred pressure curve 40, the discharge pressure becomes negative just prior to the point 44 at which the projectile leaves the launching region 24 or barrel of the gun. This eliminates the "blowby" caused when the projectile leaves the launching region and therefore reduces the noise created when pressure escapes from launch region 24. This also increases the accuracy of the gun because gases escaping from launch region 24 are not symmetrical about the projectile. Accordingly, such gases should be minimized when the projectile exits launch region 24.

The acceleration profile shown in FIG. 3 is suitable for a silent gun for covert firing. The projectile launching system 20 and fluid propulsion device 10 are also calibrated so that the projectile leaves the launching region before the negative discharge pressure of the working fluid begins to decelerate the projectile. In other words, the discharge rate of the working fluid is substantially zero at the time the projectile leaves the launching region.

The selection of the elastomeric material for the bladder sections 18*a*–18*d* that will provide the desired discharge pressure curve can be determined through finite element analysis, as is known to one skilled in the art.

Figure 4:
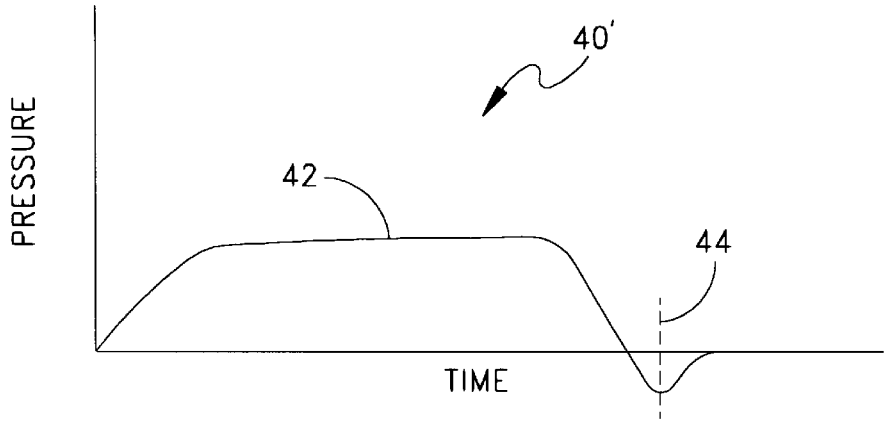
FIG. 4 is a discharge pressure curve of a fluid propulsion device according to another embodiment of the present invention.

According to another embodiment, the pressure curve 40', FIG. 4, has a period of minimal pressure change as the working fluid is discharged, as indicated by the plateau 47 of the pressure curve 46, resulting in a smooth, steady acceleration of the projectile. This type of smooth, steady acceleration profile reduces recoil at firing and provides further accuracy ideal for use in marksman competitions.

Figure 5:
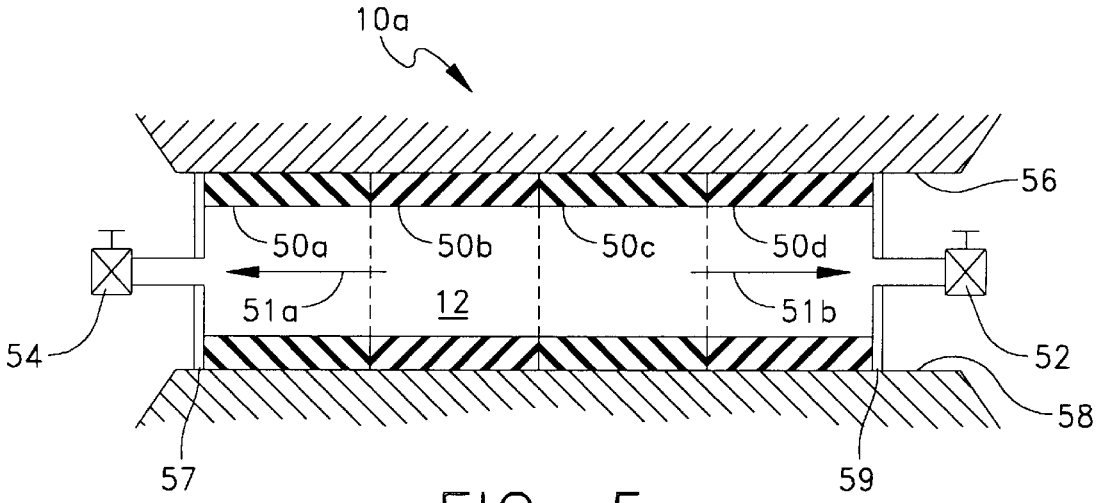
FIG. 5 is a side cross-sectional view of a fluid propulsion device according to another embodiment of the present invention.

Various embodiments of the fluid propulsion device can accomplish the variable discharge rates described above. One alternative embodiment of the fluid propulsion device 10*a*, FIG. 5, includes a plurality of elastomeric bands 50*a*–50*d* each having a different coefficient of elasticity and constrained by sidewalls 56, 58. The elastomeric bands 50*a*–50*d* are preferably bonded together with an adhesive or glue. The working fluid is received through an inlet 52, causing each elastomeric band 50*a*–50*d* to expand or elongate in a linear direction shown generally by arrows 51*a*, 51*b* by an amount corresponding to the elastic coefficient of the elastomeric material. Sliding end members 57, 59 slide like pistons in the direction of arrows 51*a*, 51*b* to accommodate the expansion of the elastomeric bands 50*a*–50*d*.

Once pressurized, the working fluid is released or discharged through an outlet 54. The sections of the chamber 12 defined by each elastomeric band 50*a*–50*d* contract at a rate corresponding to the elastic coefficient of each elastomeric band 50*a*–50*d*, and the flow rate of the working fluid through the outlet 54 corresponds to the release of potential energy in each elastomeric band 50*a*–50*d* having different coefficients of elasticity. Although the exemplary embodiment shows four elastomeric bands 50*a*–50*d*, the present invention contemplates any number of elastomeric bands depending upon the desired acceleration profile to be created by the contracting elastomeric bands.

Figure 6:
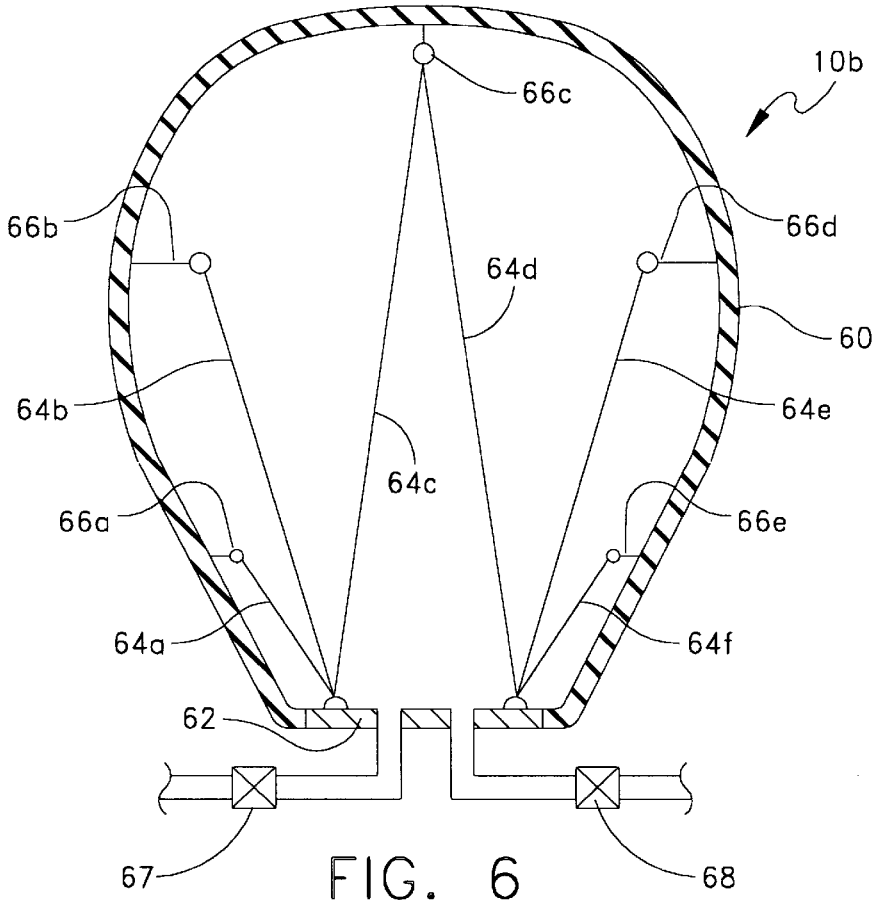
FIG. 6 is a side cross-sectional view of a fluid propulsion device according to further embodiment of the present invention.

Another embodiment of the fluid propulsion device 10*b*, FIG. 6, includes a bladder 60 mounted to a mounting portion 62. A plurality of elastomeric members 64*a*–64*f*, such as elastic cables, extend from the mounting portion 62 to respective bladder sections 66*a*–66*e* of the bladder 60. Each of the elastomeric members 64*a*–64*f* has a predetermined coefficient of elasticity. The working fluid is received into the chamber 12 formed by the bladder 60 by way of an inlet 66, causing the bladder 60 and the elastomeric members 64*a*–64*f* to expand. The working fluid is discharged through an outlet 68, and the elastomeric members 64*a*–64*f* cause the bladder sections 66*a*–66*e* of the bladder 60 to contract at different predetermined rates corresponding to the coefficients of elasticity of the elastomeric members 64*a*–64*f*. The flow rate of the working fluid discharged through the outlet 68 corresponds to the release of potential energy in each elastomeric member 64*a*–64*f* having different coefficients of elasticity.

The present invention contemplates any number of elastomeric members 64. The bladder 60 can be made of an elastomeric material or any other suitable material.

Figure 7:
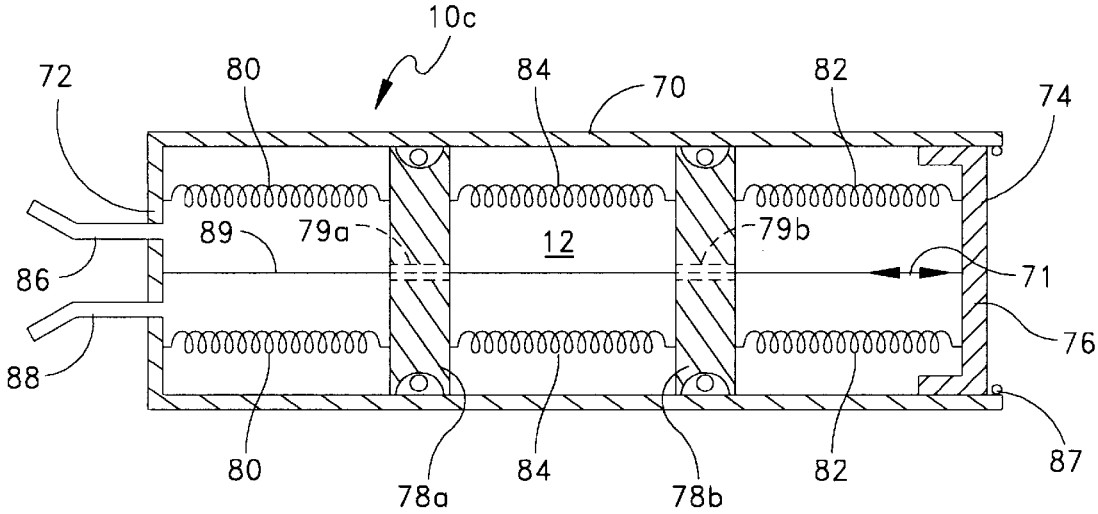
FIG. 7 is a side schematic view of a fluid propulsion device according to yet another embodiment of the present invention.

A further embodiment of the fluid propulsion device 10*c*, FIG. 7, includes a hollow member 70, such as a cylinder, having a first end 72 and a second end 74. A sealed sliding member 76 is slidably disposed in the hollow member 70 proximate the second end 74 and forms the fluid chamber 12 together with the hollow member 70. Upon receiving the working fluid through an inlet 86, the sealed sliding member 76 slides generally in the direction of arrow 71 to expand the fluid chamber 12. Upon discharging working fluid through the outlet 88, the sealed sliding member 76 slides to contract the fluid chamber 12.

One or more sliding rings 78*a*–78*b* are slidably disposed within hollow member 70 between the first end 72 and the sealed sliding member 76 to define the chamber sections. In the preferred embodiment, one or more first resilient members 80 couple the first sliding ring 78 to the hollow member 70 proximate the first end 72. One or more second resilient members 82 couple the second sliding ring 78*b* to the sealed sliding member 76. One or more third resilient members 84 couple the first sliding ring 78*a* to the second sliding ring 78*b*. Examples of the resilient members 80, 82, 84 include springs having a predetermined spring constant. At zero pressure, 78*a*, 78*b*, and 76 are collapsed and touching in the left end of the cylinder. When pressure is applied, piece 76 will move to the right and elongate springs 82; 78*b* will move to elongate springs 84, and 78*a* moves and elongates springs 80.

Each sliding ring 78*a*, 78*b* preferably includes an aperture 79*a*, 79*b* extending through the sliding ring 78*a*, 78*b* so that the working fluid passes through the sliding rings 78*a*, 78*b* during expansion and contraction of the fluid chamber 12. When the working fluid is discharged through an outlet 88, the resilient members 80, 82, 84 cause the sliding rings 78*a*, 78*b* to slide at rates corresponding to the resiliency of the resilient member 80, 82, 84 and cause sections of the fluid chamber 12 to contract at different predetermined rates.

In other words, the volume of the chamber 12 is decreasing due to the contraction of the springs 80, 82, 84. The springs 80, 82, 84 help push out the working fluid. By varying the rate of contraction the volume, and hence the pressure, is controlled. The working fluid thereby provides a variable discharge pressure curve and acceleration profile corresponding to the resiliency of the resilient members 80, 82, 84. In one example, a stop 87 is disposed behind the sliding member 76 to limit expansion. Stops (not shown) can also be provided after each of the sliding rings 78*a*–78*b*, for example, in a stepped configuration. Alternatively, a restraining cable 89 can be attached to the sliding member 76 and pass through the apertures 79*a*–79*b*. With a fixed cylinder the pressure (P) generally decreases constantly as the amount of gas in the tank is consumed, (for example if PV=nRT, if V=const, P decreases). By varying the volume (V), the pressure (P) can be maintained. By controlling the time rate of change of volume (V), various characteristic pressure curves can be obtained.

Accordingly, the fluid propulsion device of the present invention discharges working fluid at a varying discharge or flow rate by providing a fluid chamber having sections that contract at different rates. When used in a projectile launching system, the fluid propulsion device and projectile launching system are calibrated to provide a desired acceleration profile for launching a projectile with maximum possible acceleration, minimal "blast" noise, and with improved accuracy.

In light of the above, it is therefore understood that within the scope of the appended claims, the invention may be practiced otherwise than as specifically described.

What is claimed is:

1. A fluid propulsion device for discharging a working fluid at a predetermined variable discharge rate, said fluid propulsion device comprising:

a fluid chamber, said fluid chamber being expandable upon receiving said working fluid and contractible upon discharging said working fluid, said fluid chamber including a plurality of chamber sections, wherein each of said plurality of chamber sections have a different predetermined coefficient of elasticity for contracting at different predetermined rates to discharge said working fluid from said fluid chamber at said predetermined variable discharge rate determined by said chamber section;

at least one base portion joined to said fluid chamber and having at least one aperture, therein, in communication with said fluid chamber, for allowing said working fluid to be received and discharged, said base portion having a first end and a second end, said first end including said at least one aperture for receiving said working fluid, said base portion being cylindrically extended between said first and second ends;

a sealed sliding member slidably disposed in said base portion proximate said second end of said base portion, said sealed sliding member sliding within said base portion to expand said fluid chamber upon receiving said working fluid, and to contract said fluid chamber upon discharging said working fluid;

at least one sliding ring slidably disposed within said base portion between said first end and said sealed sliding member and forming said plurality of chamber sections;

at least a first resilient member coupling said at least one sliding ring to said base portion proximate said first end of said base portion; and at least a second resilient member coupling said at least one sliding ring to said sealed sliding member, wherein said first resilient member and said second resilient member have said different predetermined coefficient of elasticity to cause said plurality of chamber sections to contract at said different predetermined rates upon discharging said working fluid.

2. The fluid propulsion device of claim 1 wherein said at least first and second resilient members include at least first and second springs, each of said at least first and second springs having a different spring constant.

3. The fluid propulsion device of claim 1 wherein said at least one sliding ring includes first and second sliding rings, said first sliding ring being coupled proximate said first end of said base portion with said first resilient member, said second sliding ring being coupled to said sealed sliding member with said second resilient member, and further including a third resilient member coupling said first and second sliding rings.

4. The fluid propulsion device of claim 1 wherein said working fluid is a gas.

5. The fluid propulsion device of claim 1 wherein said at least one aperture in said base portion includes an inlet for allowing said working fluid to be received into said fluid chamber, and an outlet for allowing said working fluid to be discharged from said fluid chamber.

6. The fluid propulsion device of claim 1 further including a stop disposed behind said sealed sliding member, for preventing sliding of said sealed sliding member as said fluid chamber expands.

7. The fluid propulsion device of claim 1 further including a restraining cable attached to said sealed sliding member, for preventing sliding of said sealed sliding member beyond a predetermined amount as said fluid chamber expands.

8. A projectile launching system comprising:

a launching region having an inlet and a muzzle, for launching a projectile disposed in said launching region between said inlet and said muzzle; and a fluid chamber joined to said launching region inlet, said fluid chamber provided for expanding on receiving a working fluid therein and for contracting upon discharging said working fluid, said fluid chamber including a plurality of chamber sections wherein each of said plurality of chamber sections has a different predetermined coefficient of elasticity for contracting at a different predetermined rate, said fluid chamber being capable of discharging a working fluid at a predetermined variable discharge rate for providing a variable acceleration to said projectile in said launch region.

9. The fluid propulsion device of claim 8 wherein said fluid chamber includes an elastomeric bladder.

10. The fluid propulsion device of claim 9 wherein said elastomeric bladder includes a plurality of elastomeric bladder sections defining said plurality of chamber sections, each of said plurality of elastomeric bladder sections having said different predetermined coefficient of elasticity for contracting said plurality of chamber sections at said different predetermined rates.

11. The fluid propulsion device of claim 10 wherein said plurality of elastomeric bladder sections include a plurality of elastomeric rings bonded together.

12. The fluid propulsion device of claim 8 further comprising a plurality of elastomeric members extending from said base portion to a plurality of fluid chamber sections within said chamber, wherein each of said plurality of elastomeric members have said different predetermined coefficient of elasticity for contracting said plurality of fluid chamber sections at said different predetermined rates.

13. The fluid propulsion device of claim 8 wherein said fluid chamber includes:

said base portion having a first end and a second end, said first end including said at least one aperture for receiving said working fluid, said base portion being cylindrically extended between said first and second ends;

a sealed sliding member slidably disposed in said base portion proximate said second end of said base portion, said sealed sliding member sliding within said base portion to expand said fluid chamber upon receiving said working fluid, and to contract said fluid chamber upon discharging said working fluid;

at least one sliding ring slidably disposed within said base portion between said first end and said sealed sliding member and forming said plurality of chamber sections;

at least a first resilient member coupling said at least one sliding ring to said base portion proximate said first end of said base portion; and at least a second resilient member coupling said at least one sliding ring to said sealed sliding member, wherein said first resilient member and said second resilient member have said different predetermined coefficient of elasticity to cause said plurality of chamber sections to contract at said different predetermined rates upon discharging said working fluid.

14. The projectile launching system of claim 8 wherein said fluid chamber is calibrated such that said different predetermined rates of contraction of said fluid chamber provide a discharge rate of zero for preventing interference with said projectile when said projectile is at said launching region muzzle.

15. The projectile launching system of claim 8 wherein said fluid chamber is calibrated such that said different predetermined rates of contraction of said fluid chamber provide a rapid pressure change to said launching region inlet, for rapidly accelerating said projectile through said launching region.

16. The projectile launching system of claim 8 wherein said fluid chamber is calibrated such that said different predetermined rates of contraction of said fluid chamber provide a constant pressure to said launching region inlet, for steadily accelerating said projectile through said launching region.

17. The projectile launching system of claim 8 wherein said fluid chamber is designed for use with a compressed gas.

18. The projectile launching system of claim 17 further including:

a discharge valve joined between said fluid chamber and said launching region inlet;

a gas reservoir, for storing compressed gas; and a charge valve, coupled between said gas reservoir and said fluid chamber, for causing said compressed gas to be released into and expand said fluid chamber.

19. A fluid propulsion device for discharging a working fluid at a predetermined variable discharge rate, said fluid propulsion device comprising:

a fluid chamber, said fluid chamber being expandable upon receiving said working fluid and contractible upon discharging said working fluid, said fluid chamber including a plurality of chamber sections, wherein each of said plurality of chamber sections have a different predetermined coefficient of elasticity for contracting at different predetermined rates to discharge said working fluid from said fluid chamber at said predetermined variable discharge rate determined by said chamber section;

wherein said fluid chamber includes an elastomeric bladder having a plurality of elastomeric rings bonded together to define said plurality of chamber sections, each of said plurality of elastomeric rings having said different predetermined coefficient of elasticity for contracting said plurality of chamber sections at said different predetermined rates; and at least one base portion joined to said fluid chamber and having at least one aperture, therein, in communication with said fluid chamber, for allowing said working fluid to be received and discharged.

20. A fluid propulsion device for discharging a working fluid at a predetermined variable discharge rate, said fluid propulsion device comprising:

a fluid chamber, said fluid chamber being expandable upon receiving said working fluid and contractible upon discharging said working fluid, said fluid chamber including a plurality of chamber sections, wherein each of said plurality of chamber sections have a different predetermined coefficient of elasticity for contracting at different predetermined rates to discharge said working fluid from said fluid chamber at said predetermined variable discharge rate determined by said chamber section;

at least one base portion joined to said fluid chamber and having at least one aperture, therein, in communication with said fluid chamber, for allowing said working fluid to be received and discharged; and a plurality of elastomeric members extending from said base portion to a plurality of fluid chamber sections within said chamber, wherein each of said plurality of elastomeric members have said different predetermined coefficient of elasticity for contracting said plurality of fluid chamber sections at said different predetermined rates.

* * * * *